United States Patent [19]

Jandeska et al.

[11] 4,144,060

[45] Mar. 13, 1979

[54] METHOD OF FABRICATING RARE EARTH-TRANSITION METAL MAGNETS

[75] Inventors: William F. Jandeska, Rochester; Charles F. Netherton, Marine City, both of Mich.

[73] Assignee: General Motors Corporation, Detroit, Mich.

[21] Appl. No.: 875,072

[22] Filed: Feb. 3, 1978

[51] Int. Cl.[2] ..... B22F 3/14; B22F 3/16; H01F 1/08

[52] U.S. Cl. ..... 75/226; 29/420.5; 75/200; 75/211; 75/214; 148/101; 148/105

[58] Field of Search ..... 148/101, 103, 105, 104, 148/120, 121, 122, 420.5, 607; 29/420.5, 421 M, 596, 597, 598, 608; 75/246, 211, 247, 214, 226, 200; 264/57, 58

[56] References Cited

U.S. PATENT DOCUMENTS

| | | | |
|---|---|---|---|
| 2,048,222 | 7/1936 | Rehmann | 428/612 |
| 3,089,189 | 5/1963 | Feldman et al. | 75/200 |
| 3,157,718 | 11/1964 | O'Leary et al. | 264/57 |
| 3,706,550 | 12/1972 | Umehara et al. | 75/246 |
| 3,719,479 | 3/1973 | Flanagan | 75/226 |
| 3,802,849 | 4/1974 | Kimura et al. | 75/214 |
| 3,864,808 | 2/1975 | Doser | 29/420.5 |

FOREIGN PATENT DOCUMENTS

| | | | |
|---|---|---|---|
| 1132413 | 6/1962 | Fed. Rep. of Germany | 75/214 |
| 449780 | 2/1975 | U.S.S.R. | 75/226 |

OTHER PUBLICATIONS

Palading et al., "Application of Hot Pressing in Fabricating Radial Polarized SmCo Magnets", IEEE Magazine, vol. 11, p. 1455 (1975).

*Primary Examiner*—L. Dewayne Rutledge
*Assistant Examiner*—Michael L. Lewis
*Attorney, Agent, or Firm*—George A. Grove

[57] ABSTRACT

Self-supporting magnets, suitable for use as pole pieces of D.C. motors, are made from rare earth-transition metal powders which are pressed into thin, curved shapes and radially magnetically aligned. The compacts are restrained during sintering between special dies shaped to prevent them from warping without inhibiting circumferential or radial shrinkage.

2 Claims, 5 Drawing Figures

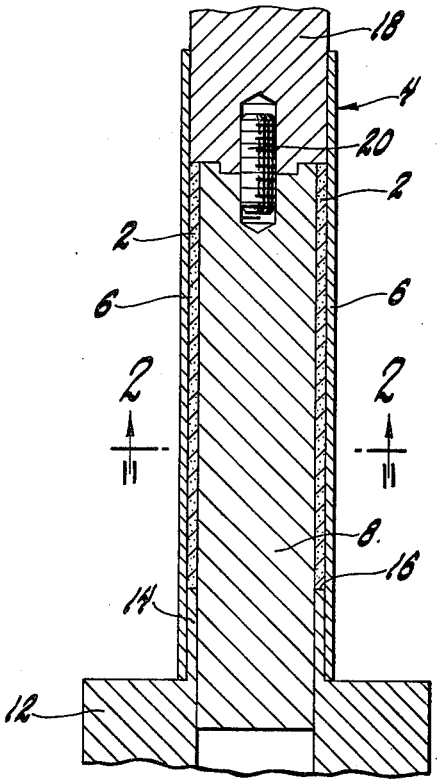
Fig. 1
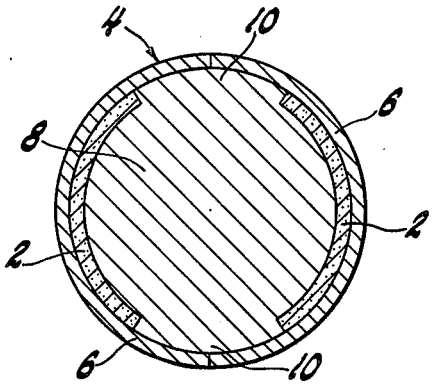
Fig. 2
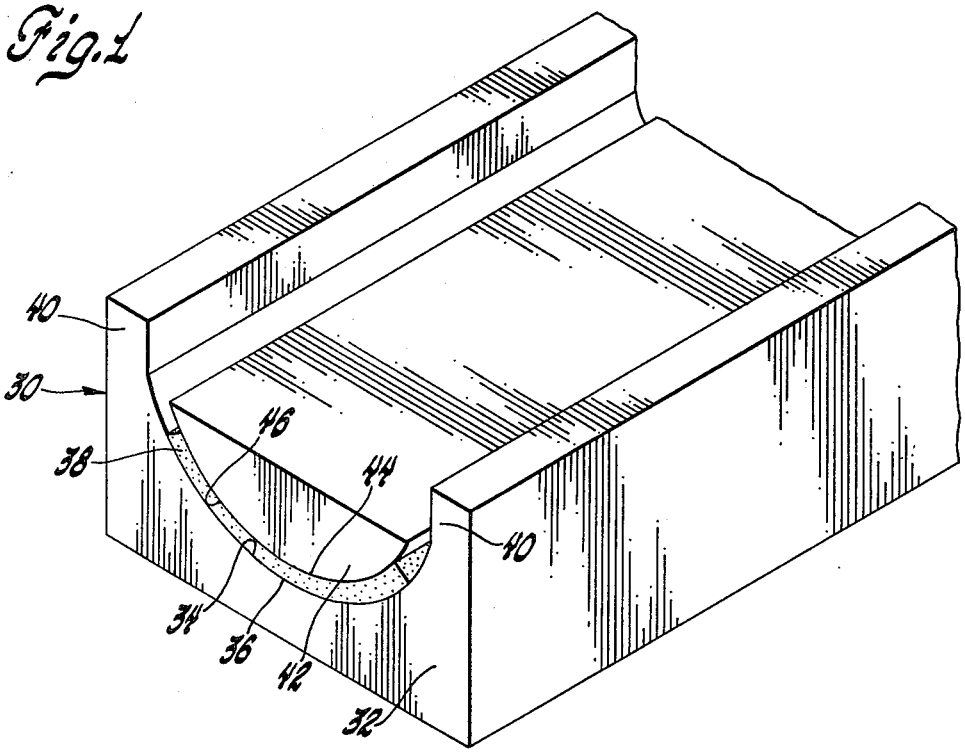

METHOD OF FABRICATING RARE EARTH-TRANSITION METAL MAGNETS

BACKGROUND OF THE INVENTION

This invention relates to a method of making self-supporting thin, curved rare earth-transition metal (RE-TM) magnets wherein the magnetic domains are substantially radially magnetically aligned. More particularly, this invention relates to a novel method of sintering and densifying green RE-TM powder compacts between specially suited dies to form magnets which are particularly useful as pole pieces for D.C. motors.

Rare earth-transition metal permanent magnets are well known for having magnetic energy products markedly higher than those of conventional permanent magnets. These properties make RE-TM magnets particularly useful as pole pieces for high torque D.C. motor applications. The size and weight of motors equipped with RE-TM magnets can be substantially reduced over conventional D.C. motors which require heavy copper windings or bulky iron or ferrite magnets. Motors with RE-TM pole magnets would be particularly useful in automotive applications such as window-lift motors, windshield wiper motors, starter motors, etc. For a motor with a cylindrical motor casing, the RE-TM magnet pole pieces should form arc segments of a thin walled cylinder sized to fit inside the casing with the magnetic domains of the magnets substantially radially aligned with respect to the axis of the cylinder.

A major obstacle to the widespread use of RE-TM magnets in D.C. motors has been the need for a commercial process for making thin, curved, self-supporting magnets. One practice has been to grind flat magnets having magnetic domains aligned in a perpendicular direction with respect to the flat surface into a thin, curved shape. Such grinding is time consuming and wasteful of relatively expensive rare earth-transition metal materials. Moreover, the direction of magnetic alignment of the resulting magnets is not optimal for the shape of the device in which it is to serve.

Another approach has been to deform a flat, sintered slab magnet into a curved shape. See, e.g., U.S. Pat. No. 3,864,808. The flat predensified magnets are heated to a temperature below the sintering temperature of the magnet but at which plastic deformation takes place under pressure exerted by a forming die resting on top of the magnet. Two major problems with this process are that the magnets must be deformed slowly to prevent them from breaking or distorting and it is only effective for shaping very thin, small magnets.

OBJECTS OF THE INVENTION

It is therefore an object of this invention to provide a commercial sintering method for rapidly and precisely forming thin, curved RE-TM magnets which are self-supporting and in which the magnetic domains are aligned substantially radially with respect to the curvature of the magnet. It is a more specific object of the invention to form such magnets from green powder compacts by sintering them between specially suited dies wherein the compacts are densified without warping or disturbing the radial magnetic alignment of the powder. The dies are provided with smooth working surfaces so that the compacts are nonadherent to them and do not bind as they shrink and densify. It is another specific object of the invention to provide a method of forming and sintering thin, curved rare earth-transition metal magnets of desired sizes and shapes suitable for use as pole pieces in D.C. motors requiring no post-sintering finishing before use.

BRIEF SUMMARY OF THE INVENTION

In accordance with a preferred embodiment of our invention, these and other objects are obtained by pressing a suitable RE-TM powder composition, such as $SmCo_5$, into a self-sustaining thin, arcuate green compact. A typical compact intended for use, e.g., as a pole piece in a small D.C. motor might define a circular cylindrical segment 45 mm long, 2 mm thick, having an inside curvature radius of 13 mm, and a circumferential arc length of 114°. For good magnetic properties, the powder is preferably compacted in the axial direction in the presence of a strong magnetic field wherein the single RE-TM powder particles are radially magnetically aligned. A powder density of at least about 65% of the theoretical density of 100% is desirable to form a green compact strong enough for further processing.

Once formed, the compact is positioned in a first die having a concave working surface shaped to conform exactly to the convex side of the green arcuate compact. A second die having a convex working surface, sized to conform to the concave side of the compact and define the desired radius of curvature of the finished magnet, is gently laid on top of the compact in the first die. The second die resting on top of the compact exerts a small uniform force, e.g., about 0.3 kPa, over its entire surface area. We have found that a force of this magnitude prevents a compact from distorting but at the same time allows the compact to freely densify and shrink during sintering. Higher restraining forces may be employed as required. However, die pressures greater than about 70 kPa may pin a compact between the dies during sintering when the strength of the compact is minimal thus preventing it from shrinking and inducing cracking of the magnet. The working surfaces of the dies are machined or otherwise worked to be smooth enough to prevent the powder from binding with the surface of the die during sintering.

The compact is heated to a suitable sintering temperature while it is restrained in the dies. A temperature of about 1115° C. is suitable for a $SmCo_5$ powder compact. Once the sintering temperature is reached the compact densifies rapidly (i.e., in about 30 minutes or less) from about 65% density to about 90–95% of the theoretical nonporous density of the composition. The sintering is conducted in a vacuum, an inert, or slightly reducing atmosphere to prevent the extremely reactive RE-TM materials from forming nonmagnetic compositions.

Natural sintering forces experienced within a thin, curved RE-TM powder metal compact cause it to warp along its axial length and its straight edges tend to curl inwardly. In our unique sintering arrangement, the compact shrinks lengthwise and circumferentially in contact with the working surface of the convex die so the edges do not curl. Consequently, the inner radius of the sintered magnet is the same as that of the green compact and the radial magnetic alignment of the powder is not disturbed by sintering. The compact does not warp during sintering because it is restrained between both the upper and lower dies along its entire length and at least a portion of its circumference. However, the compact is not pinned between the dies so that it can shrink freely in the radial, axial and circumferential directions. According to our method sintered RE-TM magnets with predictable finished dimensions may be commercially formed from powder compacts.

These and other objects and advantages of our invention will be better understood in view of the detailed description which follows. Reference will be made to the figures in which:

FIG. 1 is an elevational section of an apparatus for axially compressing RE-TM powders into green compacts of thin, curved shapes. The apparatus includes an assembly of mandrel, mandrel restraint, die liners, and punch;

FIG. 2 is a sectional view of the apparatus of FIG. 1 taken along line 2—2 showing the curved powder cavities;

FIG. 3 is a perspective view of a set of restraining dies according to our invention with a green RE-TM powder compact positioned therein;

Figure 4:
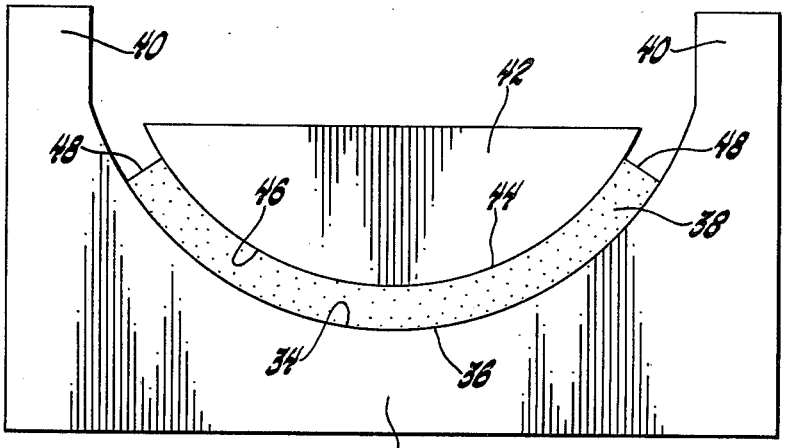
FIG. 4 is a schematic end view of a restraining die like that shown at FIG. 3 with a green powder compact in place.

Thin, curved RE-TM magnets having circular curvatures are particularly good pole pieces for small cylindrically shaped D.C. motors. In a preferred practice of our invention free-standing densified RE-TM magnets are made by a practical method which can be used to rapidly produce large numbers of magnets at relatively low cost. Precision magnets can be produced which require no final grinding or finishing before use. The magnets may be placed in cylindrical motor casings designed so that the armature and bushings can be inserted at the ends.

RE-TM compositions are a family of materials with superior magnetic properties containing one or more of the rare earth metals combined in suitable proportions with one or more of the magnetic transition metals such as iron, nickel or cobalt. The rare earth metals, in the context of RE-TM magnets, are conventionally held to include elements 57 through 71 of the periodic chart, yttrium and certain misch metals, naturally occurring blends of rare earth metals. RE-TM powders are extremely hard (approximately Rockwell C-53 in the case of $SmCo_5$) so it is difficult to press them into thin, curved green compacts having uniform powder densities and sufficient green handling strengths.

In accordance with a preferred embodiment of our invention, powder compacts were made by the method taught in copending application Ser. No. 820,600 now U.S. Pat. No. 4,123,297, also assigned to the subject assignee. The portable compacting tooling used in the method is shown at FIGS. 1 and 2.

To form a green compact, finely ground $SmCo_5$ powder, wherein substantially each powder particle is a single crystallite, is poured into the die cavities 2 of the tooling 4. The cavities 2 are formed between a split die liner 6 and a mandrel 8. The mandrel 8 is provided with opposing ribs 10 to separate the cavities 2. The mandrel is slidably retained in a tightly fitting annular restraining ring 12. This ring has an upper annular shoulder 14 which defines the bottom 16 of the cavities. A punch 18 slidable in the die liners 6 is inserted above the mandrel 8. Pin 20 assists in maintaining the alignment of the punch 14 and mandrel 8 during pressing.

The portable tooling 4 is then positioned in a suitable first press equipped with magnetizing means capable of radially magnetically aligning the $SmCo_5$ powder while the powder in die cavities 2 is initially being compacted by a stroke of the punch 18 to a density of at least 50%. The tooling 4 is then removed to a second suitable press where much higher die forces, about 100 tons per square inch, are applied to the punch 18 to compact the powder into a self-sustaining compact having a density of about 65% of the theoretical density of 100%. Two green compacts about 57 mm long, 2 mm thick, having an inside curvature radius of about 12.7 mm and an arc radius of 114° were formed in the tooling 4 for further processing according to our invention.

In accordance with a preferred embodiment a compact formed as above was sintered into a precision sized finished magnet in a specially constructed die set like that shown at FIG. 3. The die set 30 comprised a lower die 32 having a cylindrical working surface 34 shaped to conform to the convex surface 36 of the green compact 38. In this case the working surface 34 of the lower die 32 had an axial length of approximately 57 mm, and formed 120° of a cylindrical arc with a radius of 14.7 mm. Thus, when the green compact 38 was laid in the lower die 32, it was uniformly supported over its whole convex surface area. The lower die 32 was provided with vertical extensions 40 above the working surface 34 so that die sets could be stacked for sintering.

The upper die 42 was sized and shaped to conform to and rest uniformly on the concave surface 44 of the green compact 38. The upper die 42 had a working surface 46 with a radius of approximately 12.7 mm, equal to the inside radius of the green compact 38.

Since the upper die 42 rests uniformly on the concave surface 44 of a green compact 38, the die pressure can be calculated by dividing the weight of the upper die 42 by the surface area of the compact 38 adjacent the upper die 42. In this embodiment, the upper die 42 weighed approximately 90 grams and the inner arcuate surface area of the compact was about 1440 $mm^2$, corresponding to a die pressure of about 0.61 kPa (1 kPa = 0.102 $g/mm^2$) on the green compact.

The choice of die materials is important to the successful practice of our invention. In order to prevent the compact from binding during sintering a die material must be nonadherent to RE-TM powders. Generally, this means that the die material should not be reactive with RE-TM powder at elevated temperatures. Another requirement for a suitable die material is that die blocks formed from it retain their shape at sintering temperatures so that the compacts are not distorted. Die materials should also be good conductors of heat so that the compacts can be cooled at relatively constant rates in contact with the dies. Another important consideration in choosing a die material is its ability to stand up to repeated heating and cooling cycles without distorting. A preferred die material can undergo repeated thermal cycling without changing shape or becoming structurally unsound.

A pair of dies like those shown at FIG. 3 was machined from graphite. A green compact of $SmCo_5$ powder was sintered between the dies at a temperature of 1115° C. for 30 minutes in an argon atmosphere. Although the compact was densified by the sintering, the surface of the magnet was contaminated with carbon from the dies. The contaminated RE-TM powder degrades the magnetic properties of the sintered magnet.

Another set of dies was machined from cast gray iron-4% silicon. These dies were found to be unsuitable for sintering RE-TM magnets due to the warpage at sintering temperatures of about 1100° C.

A third set of dies was fabricated from Molybdenum-TZM ®, a titanium-zirconium modified molybdenum alloy which can be purchased from suppliers of such metals. We found this material to be well suited to the practice of our invention since the RE-TM powder compacts do not react with or stick to the alloy in an inert atmosphere at sintering temperatures. Moreover, the dies do not warp or deform upon heating and are good heat conductors to assure uniform cooling of the compacts. The alloy is also resistant to deterioration on repeated thermal cycling so long as the sintering is carried on in an inert atmosphere. Other suitable die materials may be used in the practice of our invention.

Figure 5:
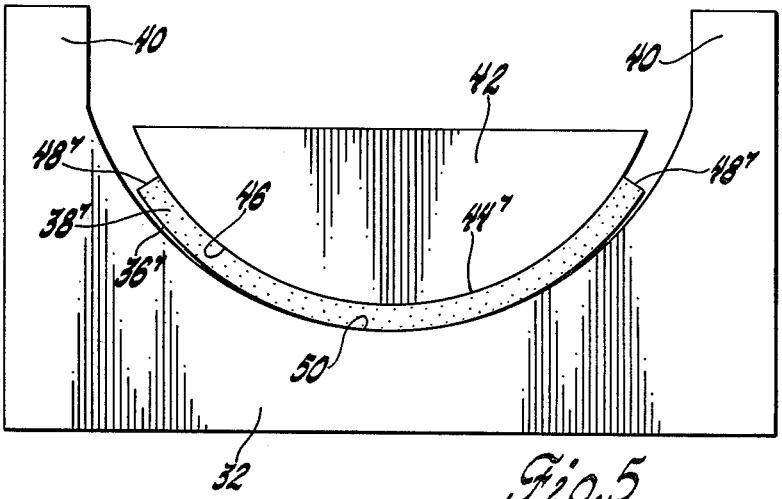
FIG. 5 is an end view like FIG. 4 showing the densified compact after sintering.

In accordance with a preferred embodiment of our invention a densified RE-TM magnet was formed as follows. The green $SmCo_5$ compact made as above was positioned in a set of matched molybdenum-TZM dies as shown at FIG. 3. The working surfaces of the dies were fine polished to prevent the compact from binding, and were sized to be in contact with the curved surfaces of the compact before sintering. FIG. 4 is an exaggerated schematic end view of the compact 38 in place before sintering. The dies and compact were placed in a sintering furnace with an argon atmosphere. Generally, RE-TM powders must be sintered in either inert or slightly reducing atmospheres to prevent oxidation of the powders and the formation of non-magnetic compounds. The temperature of the compact was brought up from room temperature to the sintering temperature of $SmCo_5$ powder, 1115° C., over the course of about 60 minutes. Densification occurred rapidly once the sintering temperature was reached, causing the compact to shrink from a density of about 65% to 95% of the theoretical in less than 30 minutes. Sintering forces experienced by the compact 38 tend to cause its straight edges 48 to curl inwards toward the center of curvature. However, in the practice of our invention the convex die 42 prevents this distortion so that the concave side 44 of the compact 38 shrinks along the working surface 46 of the convex die 42 instead. To prevent the compact from cracking, the upper die 42 is designed to apply only enough force to keep the compact edges 48 from curling without restricting compact movement due to shrinkage in the radial, axial or circumferential directions. Thus, after the compact has been densified, as shown at FIG. 5, its concave surface 44' remains adjacent to the working surface 46 of the convex die 42 but the convex surface 36' of the densified magnet 38' pulls away from the concave die 32 at the edges 48' and the compact rests along the bottom 50 of die 32.

The compact 38' was cooled at a rate of about 4° per minute in the furnace in the dies to a temperature of about 50° C. The cooling was conducted in the inert argon atmosphere to prevent both the die and the magnet materials from oxidizing. Obviously, the sintering cycle can be adjusted to suit the magnetic material being densified and to optimize the magnetic properties of the chosen RE-TM alloy.

The sintered magnet was removed from the dies and measured to be 52 mm long, 1.8 mm thick and have an arc radius of 107°. Obviously, the inside curvature radius was 12.7 mm, the same as that of the green compact. The magnet had a smooth surface and required no grinding or finishing for use.

We have found that the rate of shrinkage of RE-TM powders when they are sintered according to the practice of our invention is fairly constant. The average shrinkage of 50 $SmCo_5$ powder compacts having an initial density of about 70% and a sintered density of about 95% was measured to be about 8% in the axial direction (length), about 11% in the radial direction (thickness), and about 8% along the circumference (degrees of arc radius). Since the concave surface of the compact shrinks along the surface of the convex die there is no shrinkage with respect to the inner radius of the green compact.

Magnets 57, 46, 23 and 11.5 mm in length having an arc radius of 114° were sintered in the Mo-TZM dies described above. The compacting force of the 90 g upper die on each of the respective compacts was 0.61, 0.75, 1.50, and 3.0 kPa. Each of these restraining forces was sufficient to prevent the compact from warping but was small enough to prevent it from being pinned in the dies.

The convex die serves primarily to prevent the straight edges of a sintering compact from curling. The upper die applies a restraining force on the compact without pinning it. Therefore, the upper and lower dies can be reversed from the arrangement shown in FIGS. 3–5 without any adverse effort. That is, the lower dies can have a convex working surface and the upper die a concave surface so long as the upper die exerts a suitable compacting force.

The finished densities of the magnets sintered according to the invention fell in the range of from about 93 to 97% of the theoretical density. Obviously, if the powder density along the length of a green compact varies substantially, irregularities will result in the sintered magnet. However, green compacts formed according to the methods set out above have produced magnets with tapers generally less than 0.002 mm per mm. Dimensional reproducibility of magnets made by our invention was generally excellent.

While our invention has been disclosed in terms of specific embodiments, it will be appreciated that other forms could readily be adapted by one skilled in the art. Accordingly, the scope of our invention is to be considered limited only by the following claims. What is claimed is:

1. A method of making a rare earth-transition metal permanent magnet having a thin, curved shape by sintering a green, rare earth-transition metal powder compact formed substantially in the shape of said magnet with allowance for shrinkage upon subsequent densification and wherein the powder particles of said compact are magnetically aligned substantially radially with respect to its curvature, said method comprising positioning a said green powder compact between a first die having a curved working surface substantially matching the concave side of said curved compact and a second die having a curved working surface substantially matching the convex side of said curved compact, heating said compact between said dies to a sintering temperature for said powder, restraining said compact between said dies during said heating such that the concave side of said compact shrinks contiguously with the working surface of said first die, said first and second dies serving to prevent said compact from distorting without inhibiting its shrinkage, and continuing to heat and restrain said compact until it reaches the desired density of said magnet, whereby a freestanding permanent magnet is formed having substantially the same inside radius as said green compact, the magnetic domains of said magnet being substantially radially oriented with respect to its curvature.

2. A method of forming a sintered permanent rare earth-transition metal magnet having a thin, curved shape, the magnetic domains of said magnet being substantially radially oriented with respect to its curvature, comprising forming a green powder compact in substantially the shape of said magnet with allowance for shrinkage upon subsequent densification, the powder particles of said compact being magnetically aligned substantially radially with respect to its curvature, heating said compact to a sintering temperature for said powder between a first die having a curved working surface matching the concave side of said compact and a second die having a curved working surface matching the convex side of said compact, said die surfaces being smooth and nonadherent to said compact so that it does not bind with the dies as it shrinks during said heating, restraining said compact between said dies during said heating with a force of at least about 0.3 kPa, the magnitude of said force being sufficient to prevent said compact from warping without inhibiting its circumferential or radial shrinkage so that the radial magnetic alignment of the powder in the densified compact is substantially undisturbed, and continuing to heat and restrain said compact until it reaches the desired density of said magnet.

* * * * *